US005497409A

United States Patent [19]

Jedlitschka et al.

[11] Patent Number: 5,497,409

[45] Date of Patent: Mar. 5, 1996

[54] RADIOGENIC UNIT

[75] Inventors: Hans Jedlitschka, Chatillon; Vincent Delacroix, Versailles, both of France

[73] Assignee: GE Medical Systems, Buc, France

[21] Appl. No.: 357,428

[22] Filed: Dec. 16, 1994

Related U.S. Application Data

[62] Division of Ser. No. 180,612, Jan. 13, 1993, Pat. No. 5,384,821.

[30] Foreign Application Priority Data

Jan. 15, 1993 [FR] France ..... 93 00356

[51] Int. Cl.[6] ..... H05G 1/10

[52] U.S. Cl. ..... 378/201; 378/101; 378/142

[58] Field of Search ..... 378/101, 119, 378/122, 126, 127, 128, 142, 193, 199, 203

[56] References Cited

U.S. PATENT DOCUMENTS 5,056,126 10/1991 Klostermann et al. ..... 378/127

5,384,821 1/1995 Jedlitschka et al. ..... 378/199

*Primary Examiner*—David P. Porta
*Assistant Examiner*—Don Wong
*Attorney, Agent, or Firm*—Nilles & Nilles

[57] ABSTRACT

A radiogenic unit includes an X-ray tube having an anode disposed at a first end thereof and a cathode disposed at a second end thereof, a high-voltage supply circuit which supplies power to the X-ray tube in single pole mode and which includes a heating transformer for the cathode, and a casing. The casing includes first and second parts imperviously sealed against fluids and X-rays and hermetically sealed to one another. The first part is made of an electrically insulating material, has a first cavity formed therein in which is housed the X-ray tube, and houses a conductive element for the anode. The second part is made of an electrically insulating material and has additional cavities formed therein in which are housed the high-voltage supply circuit. Preferably, the X-ray tube is shielded by three cylinders of different potentials.

18 Claims, 6 Drawing Sheets

FIG. 5 a
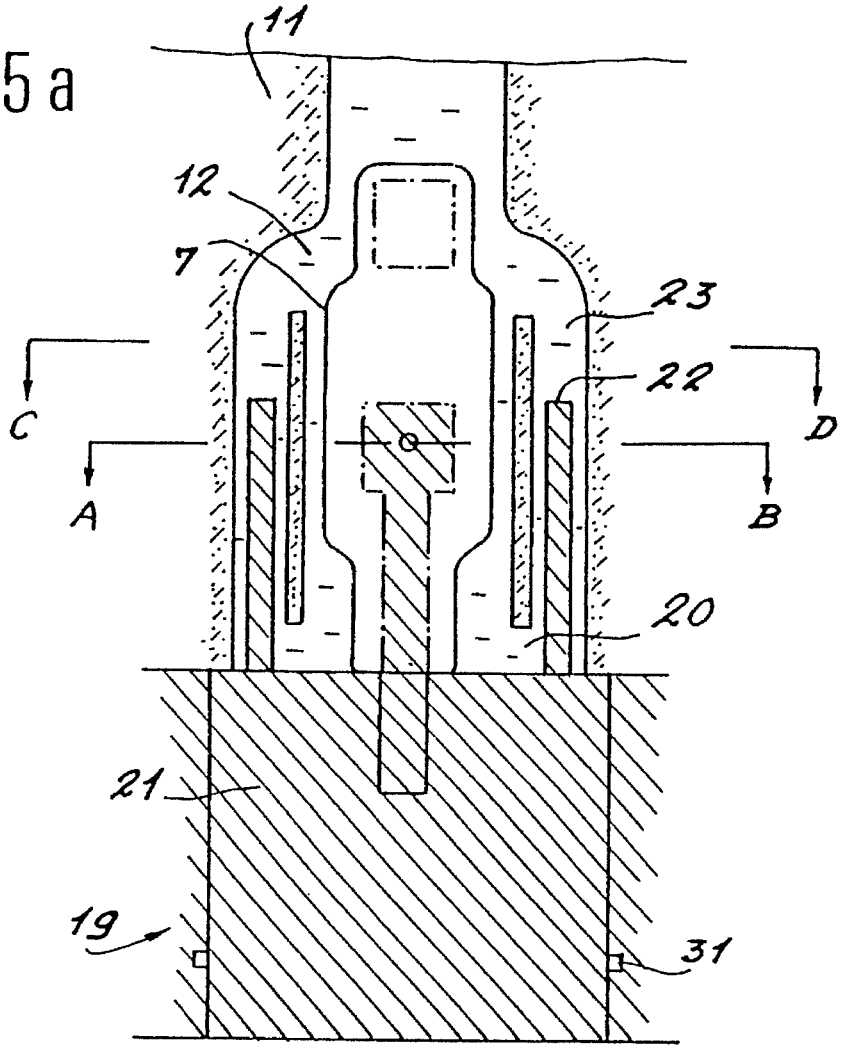
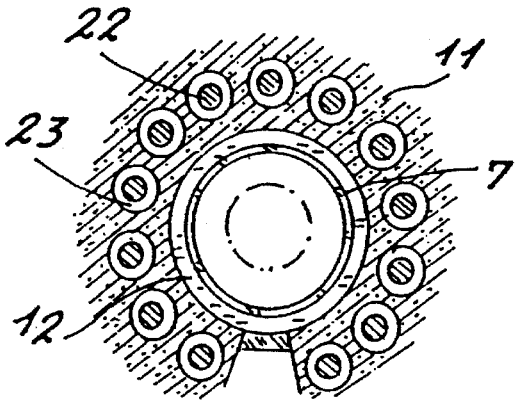
FIG. 5 b
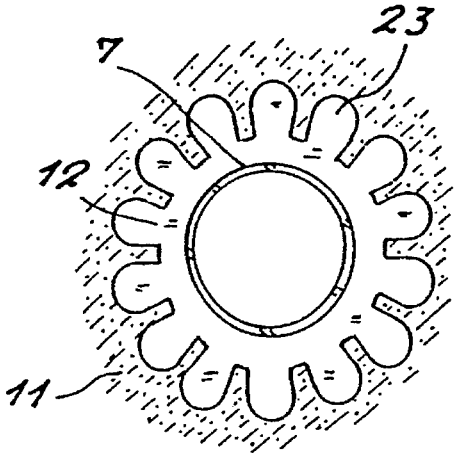
FIG. 5 c

RADIOGENIC UNIT

CROSS REFERENCE TO RELATED APPLICATION

This application is a division of commonly assigned patent application Ser. No. 08/180,612, filed Jan. 13, 1993 and which will issue on Jan. 24, 1995 as U.S. Pat. No. 5,384,821.

BACKGROUND OF THE INVENTION

1. Field of the Invention

The invention relates to a radiogenic unit and to its cooling system, enabling high power to be obtained while at the same time keeping the external casing of the apparatus cool.

Such a unit is used especially in radiology instruments.

2. Description of the Prior Art

At present, a radiogenic unit comprises an X-ray tube that is placed in a protective casing and is supplied with high voltage. The X-ray tube essentially comprises a cathode and an anode enclosed in a glass chamber under vacuum. The cathode is formed by a thermoelectronic emitter, such as a tungsten filament, that is housed in a metallic focusing element and that, when heated, emits an electron beam focused on the anode. This anode is generally constituted by a massive disk of graphite covered with a layer of a material with a high atomic number emitting X-rays when it is bombarded by an electron beam. The anode is taken to a high positive potential (of several tens of kilovolts) with respect to the cathode, and the electrical field thus created between the two electrodes accelerates the electrons that are emitted by the cathode and that strike the anode on a small surface or zone of impact of said electron beam on the anode, which constitutes the focal spot of emission of the X-radiation. The high voltages that have to be applied to the electrodes are given by supply devices called high-voltage supply devices, such as the one described in U.S. Pat. No. 5,003,452 filed on behalf of the applicant. A supply device such as this comprises inter alia a high voltage transformer connected to a voltage-doubling rectifier circuit and a heating transformer connected to the cathode.

Furthermore, the energy dissipated to produce the electron beam is converted partly into X-rays but above all into heat. This is why the X-ray tubes are positioned inside an insulating casing in which there flows a coolant fluid, generally electrically insulating oil. For a fixed anode tube, the heating of the anode is proportional to the mean power. Now, the anode on the one hand as well as the heating transformer on the other hand are electrically insulated, in bipolar mode, for a voltage equal to half of the maximum voltage. However, the cooling of the tube is limited by the fact that the two electrodes are insulated by oil whose thermal conductivity is relatively low, about three thousand times lower than that of copper. Owing to the heating of the casing and the insulation oil inside, presently used radiogenic units work with limited mean power values.

The object of the present invention is to solve these problems by proposing a cooling of the anode that is speedier and more efficient, and an insulation of the voltage of the cathode with respect to the electrical ground or frame in a volume that is reduced as compared with prior art radiogenic instruments.

SUMMARY OF THE INVENTION

The above problems are overcome by providing a novel radiogenic unit including (A) an X-ray tube having an anode disposed at a first end thereof and a cathode disposed at a second end thereof, (B) a high-voltage supply circuit supplying power to the X-ray tube in single pole mode, and (C) a heating transformer for the cathode, and (D) a casing. The casing unit includes first and second parts imperviously sealed against fluids and X-rays and hermetically sealed to one another, an electrical and thermal frame at least partially encasing the first part, and a conductive element which is electrically connected to the anode and to the frame. The first part of the casing is made of an electrically insulating material, has a first cavity formed therein in which is housed the X-ray tube, and houses the conductive element. The second part is made of an electrically insulating material and has additional cavities formed therein in which are housed the high-voltage supply circuit and the heating transformer.

Preferably, the first and second parts are each made of a dielectric plastic having a metalized exterior, and the conductive element comprises a cylinder which supports the first end of the X-ray tube and which has the same thermal conductivity as the anode.

In a particularly preferred embodiment, a shield is provided which shields the first and second pans of the radiogenic unit from X-rays from the X-ray tube and which includes first, second, and third cylinders. The first cylinder is made of a shielding material, surrounds the first end of the X-ray tube, and is taken to a zero potential with respect to the frame. The second cylinder surrounds a central portion of the X-ray tube, has a window formed therein for the passage of X-rays, and is taken to a potential approximately half of the DC supply high voltage. The third cylinder is made of a shielding material, surrounds the second end of the X-ray tube, and is taken to a potential equal to that of the DC supply high voltage. In order to lengthen electrical leakage lines and to ensure balancing of the electrical field around the X-ray tube, an insulating material is provided which electrically insulates the first, second, and third cylinders from one another. The insulating material preferably comprises a plastic such as polypropylene.

BRIEF DESCRIPTION OF THE DRAWINGS

Other features and advantages of the invention shall appear from the following description of a particular exemplary embodiment, said description being made with reference to the appended drawings, in which.

Figure 7:
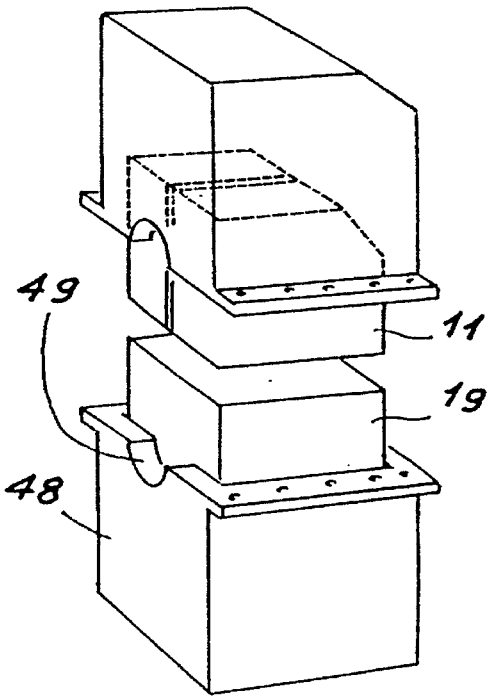
Figure 8:
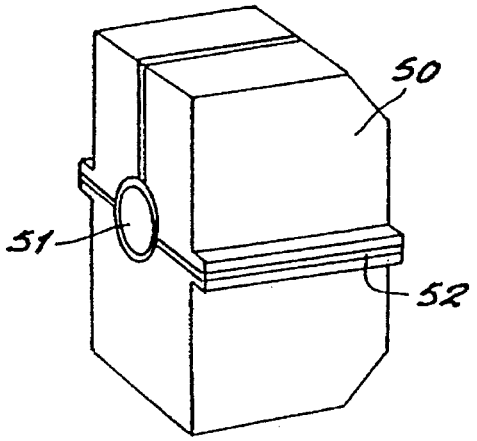
Figure 6:
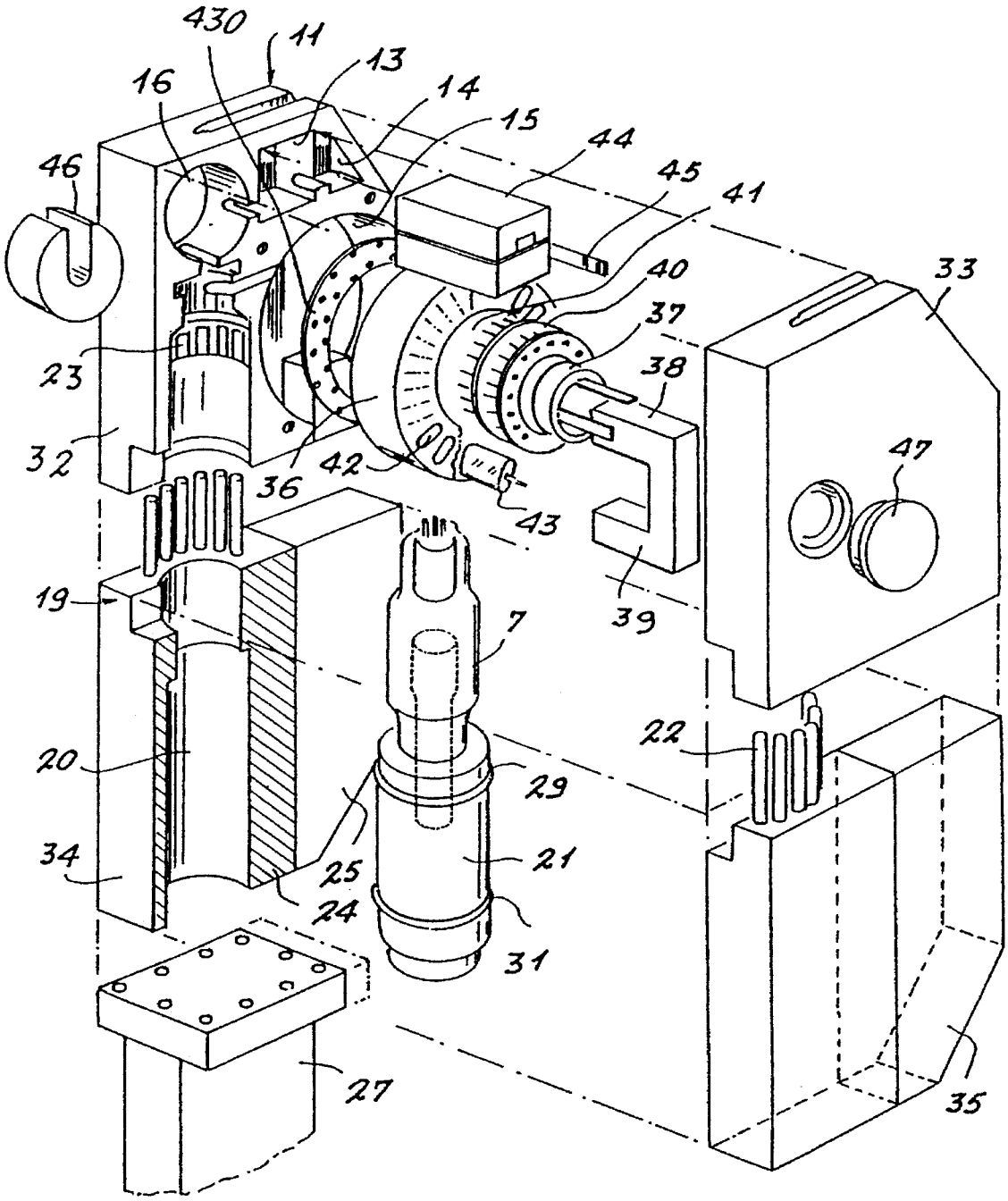
Figure 9:
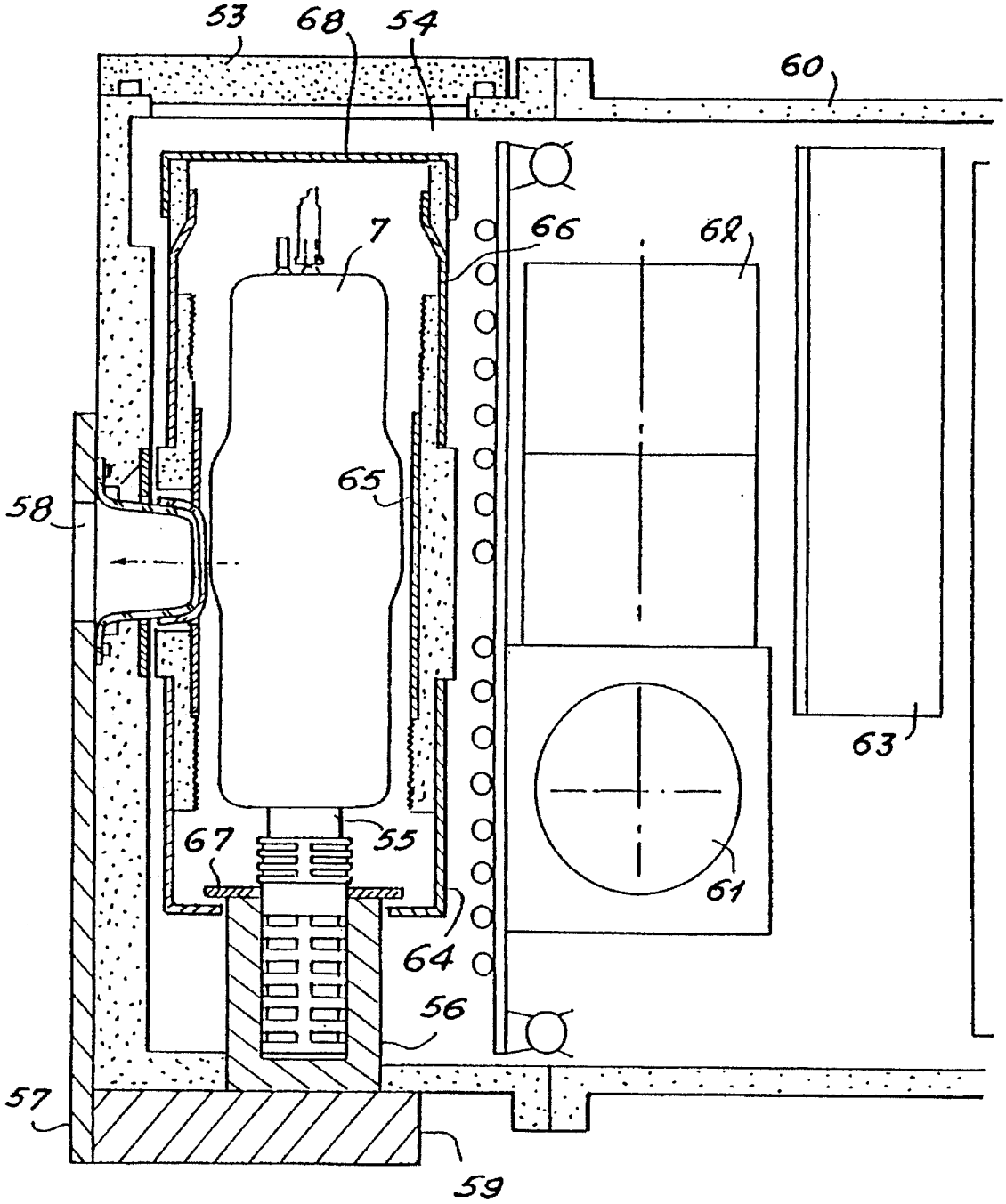

FIGS. *5a*, *5b*, and *5c* are partial views, in longitudinal section and cross-section, of a radiogenic unit according to the first embodiment of the invention, giving a detailed view of the circulation of coolant oil around the X-ray tube;

FIG. 6 is an exploded view, in cavalier projection, of the radiogenic unit according to the first embodiment of the invention;

FIGS. 7 and 8 are views in perspective of two embodiments of the external casing of the radiogenic unit according to the invention; and FIG. 9 is a longitudinal sectional view of a second embodiment of a radiogenic unit according to the invention.

The elements bearing the same references in the different figures fulfill the same functions with a view to the same results.

DETAILED DESCRIPTION OF THE PREFERRED EMBODIMENTS

Figure 1:
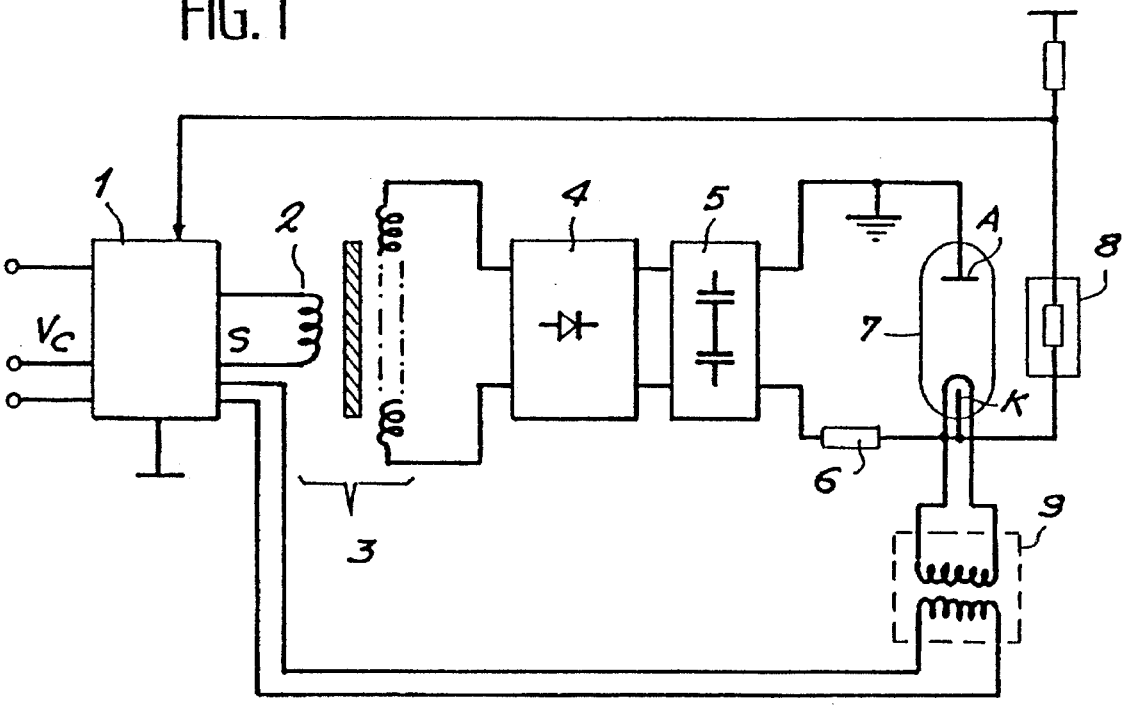
FIG. 1 is a general electrical diagram of the supply circuit of a radiogenic unit according to the invention.

FIG. 1 is the general electrical diagram of the supply circuit of a radiogenic unit according to the invention. A high frequency converter 1 receives a DC voltage $V_c$ and delivers, at the output terminals, a high frequency sinusoidal signal S which will feed the primary winding 2 of a high voltage transformer 3. The output signal of the transfer 3 is sent into a high voltage rectifier circuit 4 and then into a filtering circuit 5 formed by capacitors, before being directed to the cathode K of an X-ray tube 7 through a protection resistor 6, designed to limit the current in the event of a short-circuit in the X-ray tube. The anode A of the tube 7 is connected to the electrical frame. A high-frequency divider circuit 8 is set up between the cathode K of the tube 7 and the high frequency converter circuit 1, with the aim of measuring the high voltage potential of the cathode. The supply circuit furthermore comprises a heating transformer 9 that delivers a current flowing into the thermoemissive emitter of the cathode.

Figure 2:
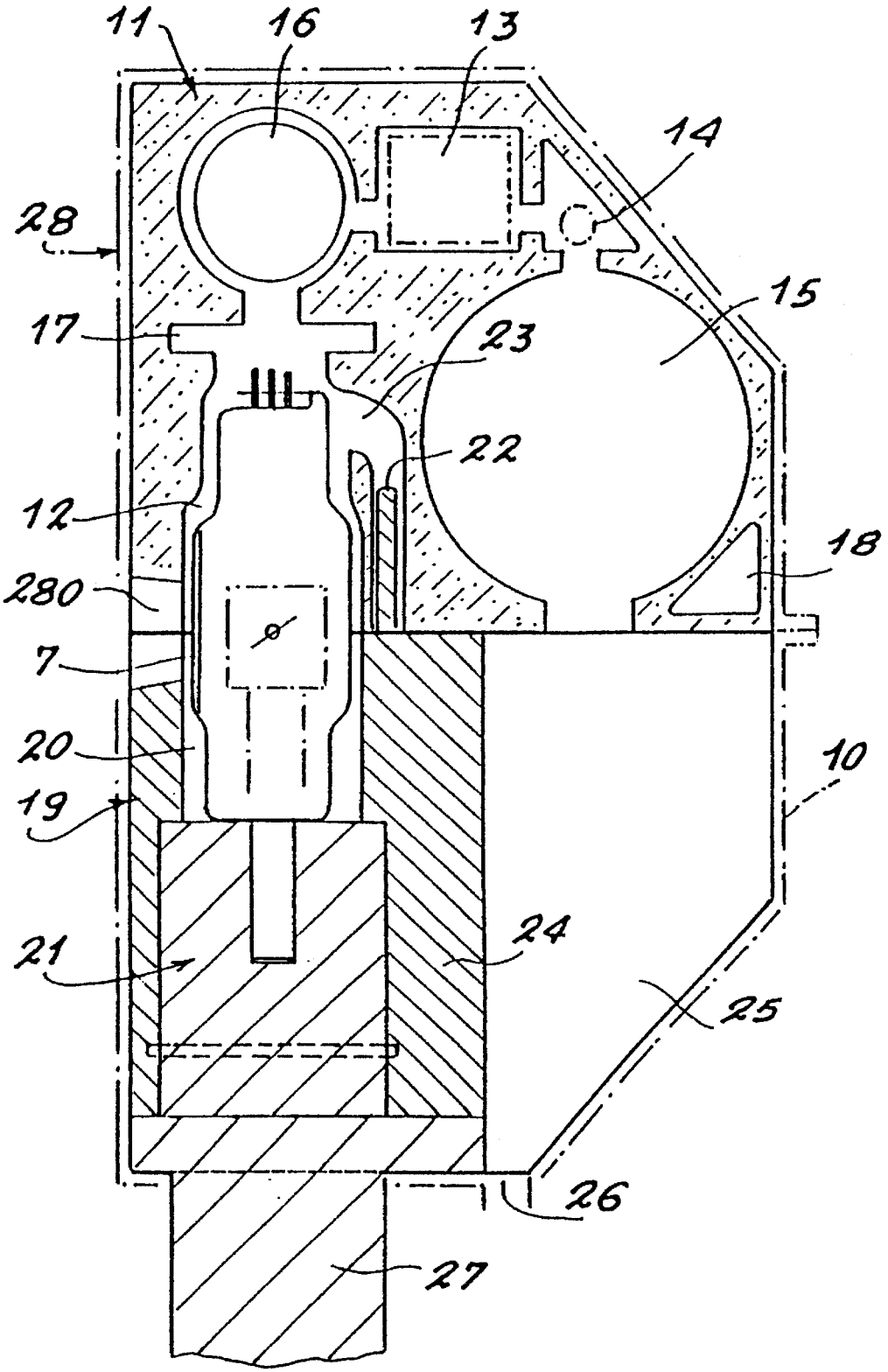
FIG. 2 is a longitudinal sectional view of a radiogenic unit according to a first embodiment of the invention.
Figure 3:
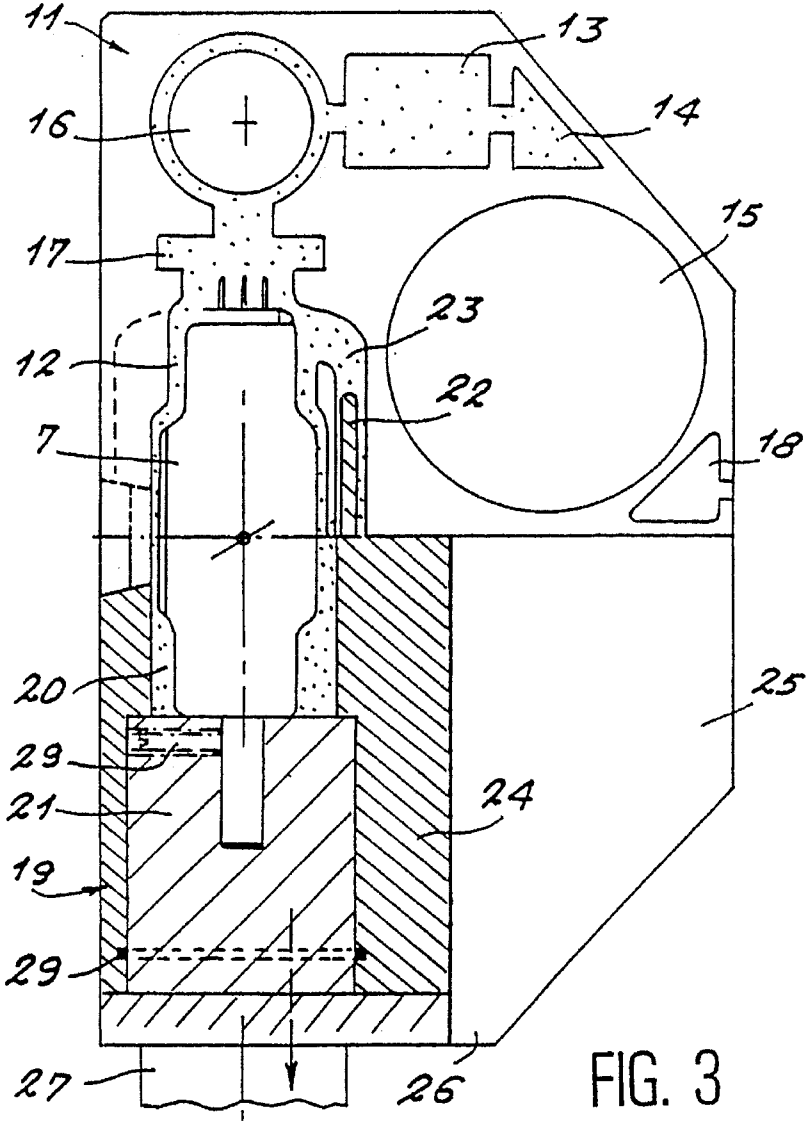

FIGS. 2 and 3 are longitudinal sectional views of two embodiments of the radiogenic unit 10 according to the invention. This radiogenic unit 10 comprises an X-ray tube 7 and its high voltage supply circuit as just described. The X-ray tube, the copper anode of which is stationary, is supplied in single-pole mode, the cathode being taken to a very high negative potential (of the order of 120 kilovolts), the anode being connected to the frame. The casing for the radiogenic unit according to the invention furthermore comprises two parts that are imperviously sealed against fluids and X-rays and are hermetically secured to each other.

In the embodiment shown in FIG. 2, the first part 11, made of an electrically insulating material such as dielectric plastic for example, has a first open cavity 12 housing the part of the X-ray tube that contains the cathode, cavities 13 to 15 for housing the elements of the high voltage supply circuit, a cavity 16 to house the heating transformer of the cathode and channels 17 for the circulation of the tube coolant fluid such as insulating oil. For example, the cavity 13 houses the high voltage measurement resistor, the cavity 14 houses the protection resistor and the cavity 15 houses the high voltage transformer and the rectifier and filter circuits. It also has a cavity 18, called a compensation volume, wherein there is placed an expansion bag for the coolant fluid.

The second part 19, made of a metal with high thermal conductivity, has an open cavity 20 housing the part of the X-ray tube that contains the anode and a cylinder 21 supporting the tube, made of a material having the same conductivity as the anode, that is electrically connected to said part which is itself connected to the electrical frame, said tube 7 and said cylinder 21 being detachable to enable the tube to be changed. Said second part is provided with metal rods 22 that are positioned around the aperture of its cavity 20 and get inserted into holes 23 positioned around the first cavity 12 of the first part 11, wherein the coolant oil flows. These rods 22 ensure the cooling of the fluid by thermal conduction towards the second metal part.

The second part 19, which is made of a copper or aluminum for example, has a plain part 24 recessed with the housing cavity 20 for the X-ray tube 7 and a hollow part 25 in which there is housed a high frequency converter 1. The low voltage DC current arrives by an aperture 26 made in the hollow part 25 of the metal part 19.

In a radiography apparatus, the second casing part 19 is fixedly joined to the support 27 of the radiogenic unit and then works as a heat sink. Indeed, it enables the extraction of the heat by thermal conduction before natural convection or cooling by a fluid for example. Furthermore, its electrical potential is zero.

In the exemplary embodiment of FIG. 2, the two casing pans 11 and 19 are enclosed in a metal cover 28 that is imperviously sealed against fluids and X-rays, except at a window 280 permitting the passage of the X-radiation sent out by the anode, formed by two elements each covering one of the two parts.

FIG. 3 shows the flow of electrically insulating oil around the X-ray tube 7, in the cavity 12 and in the channels 17 of the insulating pan 11, as well as in the part of the cavity 20 of the metal part 19 that surrounds the tube 7. The cylinder 21 supporting the X-ray tube comprises an O-ring seal 29 positioned at that end of its external surface which is closest to the tube 7, so as to limit the circulation of oil around the tube. Thus the oil heated by the tube is cooled by thermal conduction in the metal part 19 and then in the support 27 of the radiogenic unit 10, towards the thermal frame of the apparatus.

Figure 4:
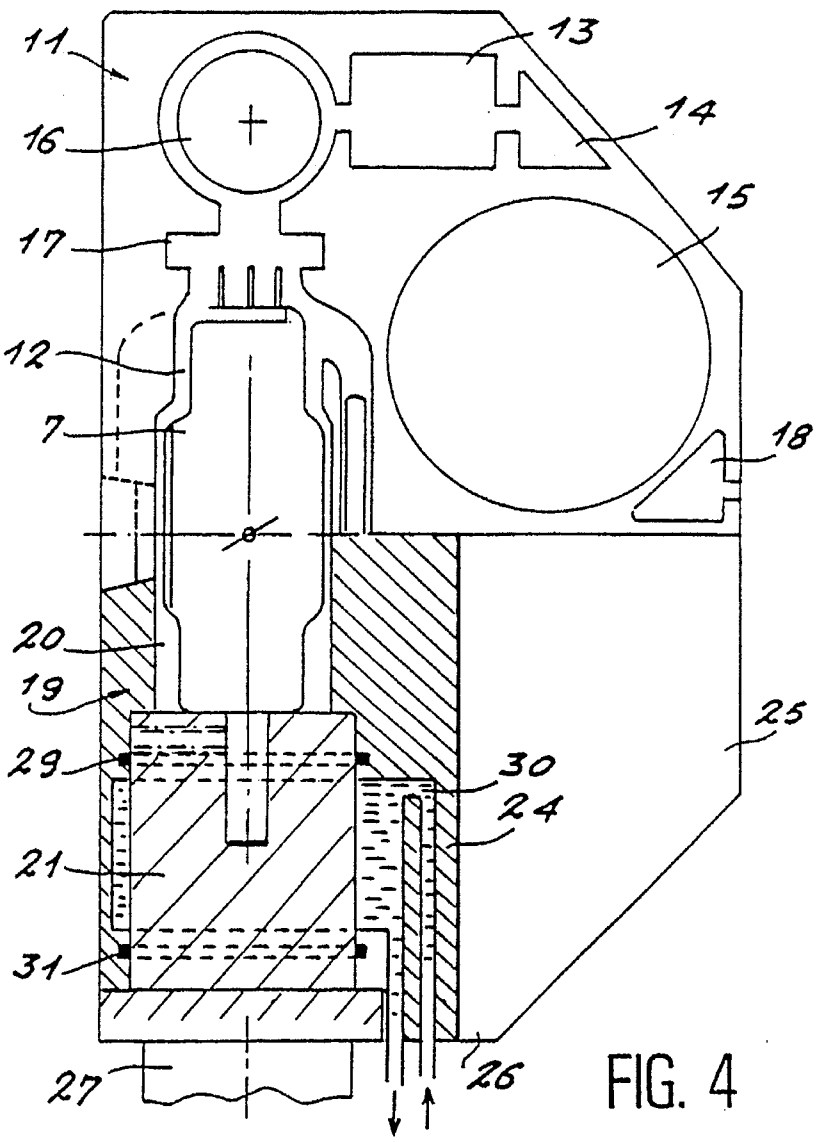
FIGS. 3 and 4 are longitudinal sectional views of a radiogenic unit according to the first embodiment of the invention, showing notably the circulation of the coolant fluids.

In FIG. 4, the supporting cylinder 21 of the X-ray tube is cooled not only by thermal conduction in the metal part 19 but also by the circulation of coolant liquid (water for example) in a circuit 30 made around the cylinder. A second O-ring seal 31 is positioned at that end of its external surface which is furthest from the tube 7 so as to limit the circulation of liquid around the cylinder 21.

FIG. 5*a* is a detailed longitudinal sectional view of the junction of the two casing parts 11 and 19 around the X-ray tube 7. The coolant oil circulates around the tube 7 inside the cavity 12 of the part 11 and in holes 23 made in the part 11 around the cavity 12. In these holes 23, there are embedded metal rods 22 that are arranged around the aperture of the cavity 20 of the metal part 19 and are designed to cool the oil flowing in holes 23 by thermal conduction towards the thermal frame constituted by the part 19 and the support 27 of the radiogenic apparatus to which it is connected. The rods 22 do not penetrate to the bottom of the holes 23, just as the internal wall of said holes does not touch the part 19. This is so as to facilitate the circulation of the coolant oil throughout the length of the metal rods. FIG. 5*b* is a view along a cross-section AB of the junction of the two parts 11 and 19 around the tube 7, at the anode, showing the embedding of the metal parts 22 of the metal part 19 in the holes 23 of the insulating part 11. The coolant oil flows both around the glass wall of the X-ray tube 7 and in the holes 23 along the rods 22. FIG. 5*c* shows the same junction but along a section CD where the holes 23 are not filled by the rods 22.

FIG. 6 which is an exploded view, in cavalier projection, of the radiogenic unit according to the invention, shows an embodiment that is a particular embodiment since each casing part is formed by two shells, thus making it easier to mount the different elements of the high voltage supply circuit in the unit. The insulating first part 11 is formed by two shells 32 and 33, made of molded plastic and secured to each other imperviously by a seal. The second metal part 19 is itself also formed by two shells 34 and 35, each comprising a solid part and a hollow part placed in a position where they face each other so as to constitute, respectively, the solid part 24 and the hollow part 25 of the part 19.

In the two insulating shells 32 and 33, the elements of the supply circuit are housed: in the central part of a shell 36, there is housed the primary winding 37 as well as a branch 38 of the magnetic circuit of the high voltage transformer 39; the secondary winding 40 is housed in an annular compartment 41 located around the central part of said shell 36, which furthermore comprises annular compartments 42 at its periphery to house the capacitors 43 of the filtering circuit; the rectifier diodes are placed on a ring 430. This first element of the supply circuit of the X-ray tube is placed in the cavity 15. A measurement resistor 44 is housed in the cavity 13, a protection resistor is housed in cavity 14, and a heating transformer 46 is housed in the cavity 16. An inspection hole 47 is drilled in one of the two insulating shells in order to enable checking of the electrical connections with the tube.

The two metal shells 34 and 35 house the X-ray tube 7 and the metal cylinder 21 that supports it. These two shells 34 and 35 are each provided with metal rods 22 that get embedded in the two insulating shells 32 and 33. Once they are joined together, these two shells 34 and 35 are fixed to the support 27 of the radiogenic unit.

FIG. 7 shows a view in cavalier projection of the entire radiogenic unit according to the invention. The two casing parts, namely, the insulating part 11 and the metal part 19, are enclosed in a metal cover 48 that is imperviously sealed against fluids and X-rays emitted by the tube, except through a window 49. For reasons of easy assembling, the cover is made of two parts that are fixedly joined to each other. According to another embodiment (FIG. 8), the two casing parts 11 and 19 are themselves covered with a layer 50 of leaded metal, except at a window 51 for the emission of the X-rays, and are hermetically sealed by a seal 52. According to another embodiment, the two parts 11 and 19 are joined together by a seal and are placed within a plastic cover, the internal faces of which are covered with a layer of lead.

In the embodiment of the radiogenic unit shown in FIG. 9, the two sealed casing parts are positioned differently from those of the first embodiment described here above. The first casing part 53, made of electrically insulating material such as dielectric plastic, for example, has a large open cavity 54 in which the X-ray tube 7 is housed. The end 55 of the tube in which the anode is housed is supported by a cylinder 56 made of a material having the same thermal conductivity as the anode, for example copper, that is detachable to facilitate operations for changing the tube. This cylinder 56 is fixed to an aluminum flange or electrical frame 59 used as a support for the set and enabling the removal of the heat of the anode and that of the cylinder 56 by thermal conduction towards the stand bearing the radiogenic unit. The anode is connected electrically to said cylinder 56 which is itself connected to the electrical frame 59. Said part 53 is covered with an aluminum plate 57 except at the position of a window 58, pierced to let through the X-rays, enabling the fixing of an X-ray collimator.

The second casing part 60, which is also made of an electrically insulating material, comprises housing cavities 61 to 63 to house the high voltage supply circuit for the tube and to house the heating transformer for the cathode.

The shielding of the tube 7, in this embodiment, is laid close to the tube in order to reduce the required mass of lead. It is constituted first of all by a first cylinder 64, made of lead, that surrounds the part of the tube 7 comprising the anode and is taken to a zero potential with respect to the ground or frame 59, secondly by a second cylinder 65 that surrounds the central part of the tube 7, with a window letting through the X-rays, and that is carried to a potential equal, for example, to half of the DC supply high voltage of the tube 7 in order to ensure better electrical insulation of the tube, and finally by a third cylinder 66, made of lead, that surrounds the part of the tube 7 comprising the cathode and is taken to a potential equal to the supply high voltage. These three parts of the shielding, whose electrical voltages are different in order to balance the field around the X-ray tube 7, are electrically insulated from one another by walls of insulating plastic, polypropylene for example, in order to lengthen the electrical leakage lines (and thereby strengthen the electrical insulation) and enable efficient circulation of oil around the tube. The first cylinder 64 is closed at its base by a lead ring 67 placed against the copper cylinder 56 and taken to the potential of the frame 59. The third cylinder 66 is closed by a lead lid 68 which, like itself, is taken to the potential of the supply high voltage of the tube 7. Coolant oil flows inside the two parts 53 and 60, notably around the X-ray tube 7. The two parts 53 and 60 are made of dielectric plastic that is metallized on the exterior.

The radiogenic unit according to the invention has a large number of major advantages, such as the insulation of the voltage of the cathode with respect to the frame in a volume that is smaller than in the prior art and the possibility of placing the heating transformer and the high voltage transformer together with the rectifier and filter circuits as close as possible to the cathode of the tube to avoid the use of cables and electrical connectors. Through the speedy removal of heat from the anode in direct contact with a thermal frame connected to the mounting of the apparatus, the external casing of the radiogenic unit remains cold, thus making it possible to increase its mean power. The making of the unit with two molded casing parts makes it possible to obtain a highly compact unit, with a reduced volume and weight, that is simple to assemble and has a low cost.

We claim:

1. A radiogenic unit comprising a casing in which is disposed an X-ray tube having a high-voltage supply circuit in a single-pole mode, said casing further comprising:

a first casing part, said first casing part being made of an electrically insulative material and being metalized on the exterior, said first casing part including a large open cavity in which is housed said X-ray tube, a first section of said X-ray tube containing an anode supported by a copper cylinder, said anode being electrically connected to said cylinder and said cylinder being electrically connected to an electrical and thermal frame of said unit; and a second casing part, said second casing part being made of an electrically insulative material and being metalized on the exterior, said second casing part including cavities to house said high-voltage supply circuit of said tube and to house a heating transformer for a cathode;

wherein said first and second casing parts are imperviously sealed against fluids and X-rays and are hermetically sealed to each other.

2. A radiogenic unit according to claim 1, wherein said first and second casing parts are sealed against X-rays by a shielding of said tube, said shielding being laid close to said tube, and said shielding comprising:

a first cylinder made of lead, said first cylinder surrounding said first tube section containing said anode, said first cylinder being closed at its base by a lead ring placed against said copper cylinder and being taken to a zero potential with respect to said frame;

a second cylinder, said second cylinder surrounding a second and central section of said tube, with a window letting through X-rays, and said second cylinder being carried to a potential close to half of a DC supply voltage;

a third cylinder made of lead, said third cylinder surrounding a part of said tube containing said cathode, said third cylinder being closed by a lid made of lead and being taken to a potential equal to said DC supply voltage;

wherein said first, second and third cylinders are electrically isolated from one another by walls of insulating plastic in order to strenghten the electrical insulation between said cylinders and ensure the balancing of the electrical field around said X-ray tube.

3. A radiogenic unit comprising:

a casing;

an X-ray tube disposed in said casing and having an anode disposed at a first end thereof and a cathode disposed at a second end thereof;

a high-voltage supply circuit which is disposed in said casing, which supplies power to said X-ray tube in a single pole mode and which includes a heating transformer for said cathode;

an electrical and thermal frame at least partially surrounding said casing; wherein said casing includes (1) first and second parts imperviously sealed against fluids and X-rays and hermetically sealed to one another and (2) a conductive cylinder which is electrically connected to and has the same thermal conductivity as said anode and which is electrically connected to said frame, said first part (1) is made of an electrically insulating material having a metalized exterior, (2) has an open cavity formed therein in which is housed said X-ray tube, and (3) houses said conductive cylinder, and wherein said second part (1) is made of an electrically insulating material having a metalized exterior and (2) has open cavities formed therein in which are housed said high-voltage supply circuit.

4. A radiogenic unit according to claim 3, wherein said X-ray tube is supplied with a DC supply high voltage, and further comprising a shield which shields said first and second parts of said radiogenic unit from X-rays, said shield including a first cylinder which (1) is made of lead, (2) surrounds said first end of said X-ray tube, (3) is taken to a zero potential with respect to said frame;

a lead ring which contacts said first cylinder;

a second cylinder which (1) surrounds a central portion of said X-ray tube, (2) has a window formed therein for the passage of X-rays, and (3) is taken to a potential approximately half of said DC supply high voltage;

a third cylinder which (1) is made of lead, (2) surrounds said second end of said X-ray tube, and (3) is taken to a potential equal to that of said DC supply high voltage; and a lid which is made of lead and which closes said third cylinder, and further comprising an insulating plastic material electrically insulating said first, second, and third cylinders from one another in order to lengthen electrical leakage lines and to ensure balancing of the electrical field around said X-ray tube.

5. In a radiogenic unit including an X-ray tube having an anode disposed at a first end thereof and a cathode disposed at a second end thereof, and a high-voltage supply circuit which supplies power to said X-ray tube in a single pole mode and which includes a heating transformer for said cathode, an apparatus which comprises:

first and second casing parts imperviously sealed against fluids and X-rays and hermetically sealed to one another;

an electrical and thermal frame at least partially surrounding said first part; and a conductive element which is electrically connected to said anode and to said frame, wherein said first part (1) is made of an electrically insulating material, (2) has a first cavity formed therein in which is housed said X-ray tube, and (3) houses said conductive element, and wherein said second part (1) is made of an electrically insulating material and (2) has additional cavities formed therein in which are housed said high-voltage supply circuit.

6. An apparatus according to claim 5, wherein said first and second parts are each made of a dielectric plastic having a metalized exterior.

7. An apparatus according to claim 5, further comprising a coolant fluid disposed in said first cavity around said X-ray tube.

8. An apparatus according to claim 5, wherein said conductive element comprises a cylinder which supports said first end of said X-ray tube.

9. An apparatus according to claim 8, wherein said cylinder is formed from a material having the same thermal conductivity as said anode.

10. An apparatus according to claim 8, wherein said cylinder is detachable from said first part to permit replacement of said X-ray tube.

11. An apparatus according to claim 5, wherein said additional cavities comprise three separate cavities formed in said second part.

12. An apparatus according to claim 5, wherein said X-ray tube is supplied with a DC supply high voltage, and further comprising a shield which shields said first and second casing parts from X-rays, said shield including a first cylinder which (1) is made of a shielding material, (2) surrounds said first end of said X-ray tube, and (3) is taken to a zero potential with respect to said frame;

a second cylinder which (1) surrounds a central portion of said X-ray tube, (2) has a window formed therein for the passage of X-rays, and (3) is taken to a potential approximately half of said DC supply high voltage; and a third cylinder which (1) is made of a shielding material, (2) surrounds said second end of said X-ray tube, and (3) is taken to a potential equal to that of said DC supply high voltage.

13. An apparatus according to claim 12, wherein said first cylinder is made of lead.

14. An apparatus according to claim 12, further comprising an insulating material electrically insulating said first, second, and third cylinders from one another in order to lengthen electrical leakage lines and to ensure balancing of the electrical field around said X-ray tube.

15. An apparatus according to claim 14, wherein said insulating material comprises a plastic.

16. An apparatus according to claim 15, wherein said plastic is polypropylene.

17. An apparatus according to in claim 12, wherein said shield further comprises a ring which is (1) made of a shielding material, (2) placed against said first cylinder, and (3) taken to the potential of said supply high voltage, and a lid which is made of a shielding material and which closes said third cylinder.

18. An apparatus according to claim 17, wherein said ring and said lid are made of lead.

* * * * *